United States Patent [19]

Caveney et al.

[11] 3,949,449

[45] Apr. 13, 1976

[54] INTEGRAL ONE-PIECE CABLE TIE

[75] Inventors: Jack E. Caveney, Chicago; Roy A. Moody, Flossmoor, both of Ill.

[73] Assignee: Panduit Corporation, Tinley Park, Ill.

[22] Filed: Apr. 9, 1969

[21] Appl. No.: 814,694

[52] U.S. Cl. ..... 24/16 PB

[51] Int. Cl.[2] ..... B65D 63/00

[58] Field of Search ..... 24/73.7, 30.5 PB, 16 PB; 248/68, 74, 74 PB, 68 R

[56] References Cited

UNITED STATES PATENTS

| | | | |
|---|---|---|---|
| 2,936,980 | 5/1960 | Rapata | 248/74 PB |
| 3,009,220 | 11/1961 | Fein | 24/16 PB |
| 3,214,808 | 11/1965 | Litwin | 24/16 PB |
| 3,224,056 | 12/1965 | Joffe | 24/16 PB |
| 3,368,247 | 2/1968 | Orban | 24/16 PB |
| 3,471,109 | 10/1969 | Meyer | 248/68 |
| 3,484,905 | 12/1969 | Eberhardt | 24/16 PB |
| 3,486,201 | 12/1969 | Bourne | 24/16 PB |
| 3,494,002 | 2/1970 | Kabel | 24/16 PB |
| 3,542,321 | 11/1970 | Kohobka | 248/68 R |

*Primary Examiner*—Donald A. Griffin

*Attorney, Agent, or Firm*—Prangley, Dithmar, Vogel, Sandler & Stotland

[57] ABSTRACT

An integral one-piece cable tie including an elongated flexible strap having a row of teeth thereon, a frame integral with one end of the strap and having an abutment wall and an end wall and an entry surface and an exit surface and a strap-receiving opening therethrough, a ledge on the end wall extending toward the abutment wall, and a pawl pivotally mounted on and integral with the ledge within the opening end having a set of teeth thereon shaped complementary to the row of teeth.

30 Claims, 10 Drawing Figures

FIG. 1
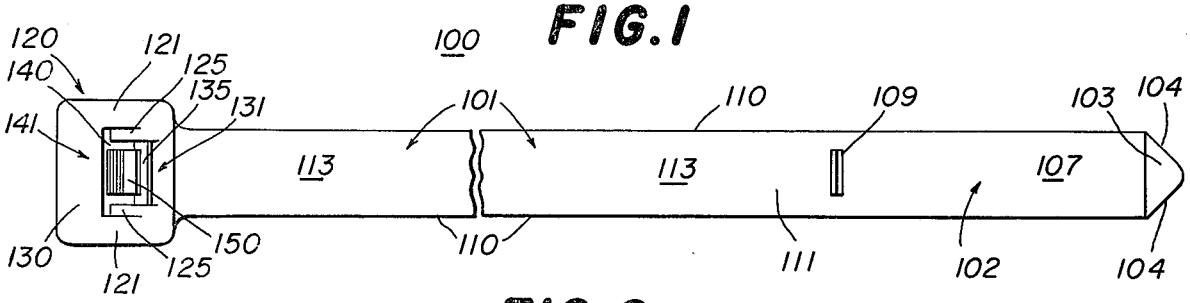
FIG. 2
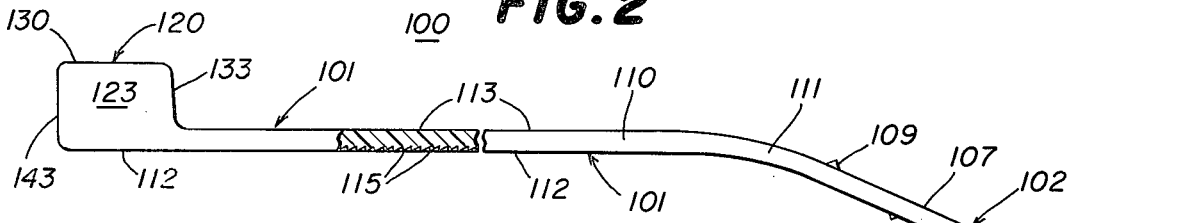
FIG. 3
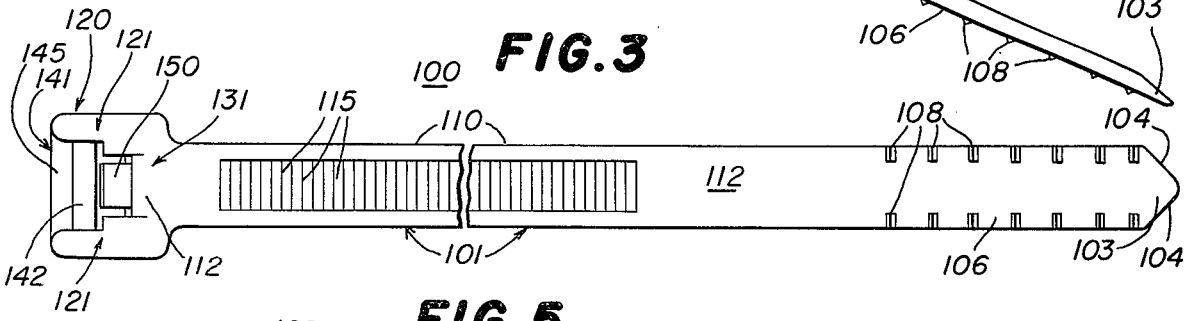
FIG. 5
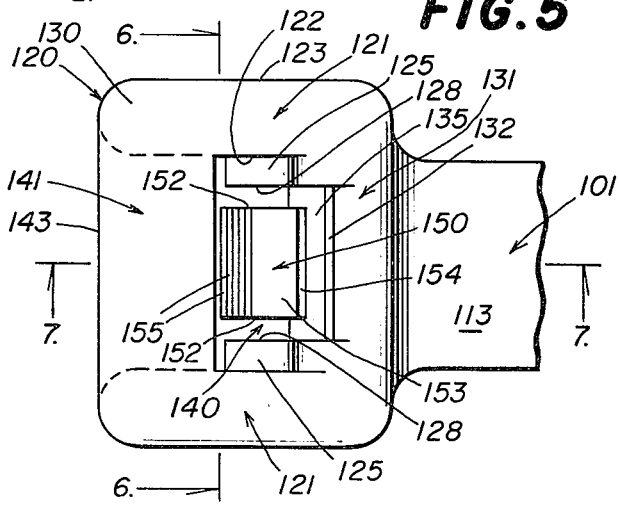
FIG. 4
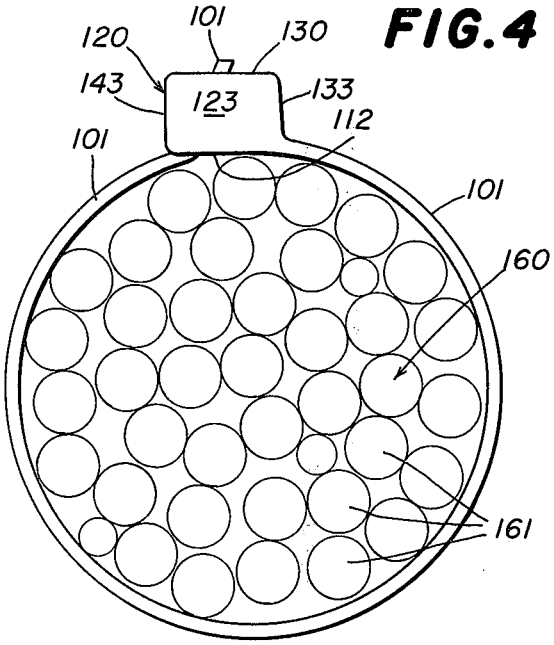
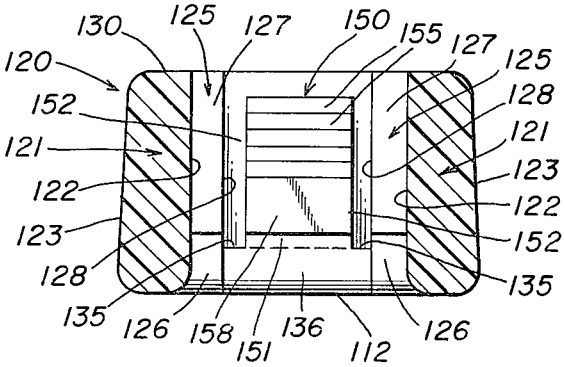
FIG. 6
INVENTORS
JACK E. CAVENEY
ROY A. MOODY
BY Prangley, Clayton, Mullin & Vogel
ATTYS.

INTEGRAL ONE-PIECE CABLE TIE

The present invention is directed to an integral one-piece cable tie to be tensioned about a bundle of wires and the like, and particularly to such a cable tie wherein the pawl forming a part thereof is mounted on a ledge extending from an end wall of an associated frame within which the pawl is disposed.

It is an object of the invention to provide an integral one-piece cable tie to be tensioned about a bundle of wires and the like, comprising an elongated flexible strap having a row of teeth disposed on one longitudinal surface thereof, a frame integral with one end of the strap and including an end wall and an abutment wall and having an entry surface and an exit surface and a strap-receiving opening therethrough, a ledge on the end wall extending longitudinally therefrom toward the abutment wall, a pawl disposed within the frame in the strap-receiving opening and pivotally mounted on and integral with the ledge, the abutment wall having a strap-bearing surface disposed toward the pawl and defining therewith a strap-receiving throat, and a set of teeth on the pawl arranged transversely with respect thereto and disposed toward the abutment wall and shaped to engage the row of teeth on the strap.

Another object of the invention is to provide a cable tie of the type set forth, wherein the frame has a pair of spaced-apart side walls interconnected by the end wall and the abutment wall, the ledge extending between the side walls on the end wall and longitudinally toward the abutment wall.

Still another object of the invention is to provide a cable tie of the type set forth, wherein the pawl is connected to the ledge by a flexible and collapsible hinge, initial retrograde movement of the strap after tensioning thereof exerting pressure on the pawl causing the hinge to collapse and to seat the pawl upon the ledge in the tensioned position.

A further object of the invention is to provide a cable tie of the type set forth, wherein the crests of a plurality of the teeth in the set of teeth are positioned opposite the strap-bearing surface and lie in a common surface which is disposed substantially equidistantly from the strap-bearing surface in the tensioned condition of the strap with the strap-bearing surface extending beyond the plurality of teeth.

In connection with the foregoing object, another object of the invention is to provide cable calbe tie of the type set forth, wherein the crests of the plurality of teeth lie in a plane substantially parallel to the planar strap-bearing surface.

Still another object of the invention is to provide a cable-tie of the type set forth, wherein the planes defined by the surfaces of the set of teeth disposed toward the entry surface in the tensioned condition converge with the planes defined by the surfaces of the pawl disposed toward the exit surface in the tensioned condition at points disposed on the exit side of the frame at angles as small as 0°.

Further features of the invention pertain to the particular arrangement of the parts of the cable tie, whereby the above-outlined and additional operating features thereof are attained.

The invention, both as to its organization and method of operation, together with further objects and advantages thereof, will best be understood by reference to the following specification taken in connection with the accompanying drawings, in which:

FIG. 1 is a plan view with certain parts broken away of an integral one-piece cable tie made in accordance with and embodying the principles of the present invention;

FIG. 2 is a side elevational view with certain parts broken away of the cable tie of FIG. 1;

FIG. 3 is a plan view with certain parts broken away of the reverse side of the cable tie of FIGS. 1 and 2;

FIG. 4 is a view illustrating the cable tie of FIGS. 1 to 3 applied about a bundle of wires;

FIG. 5 is an enlarged fragmentary plan view of the frame forming a part of the cable tie of FIGS. 1 to 3;

FIG. 6 is a view in vertical section along the line 6—6 of FIG. 5; and

Figure 8:
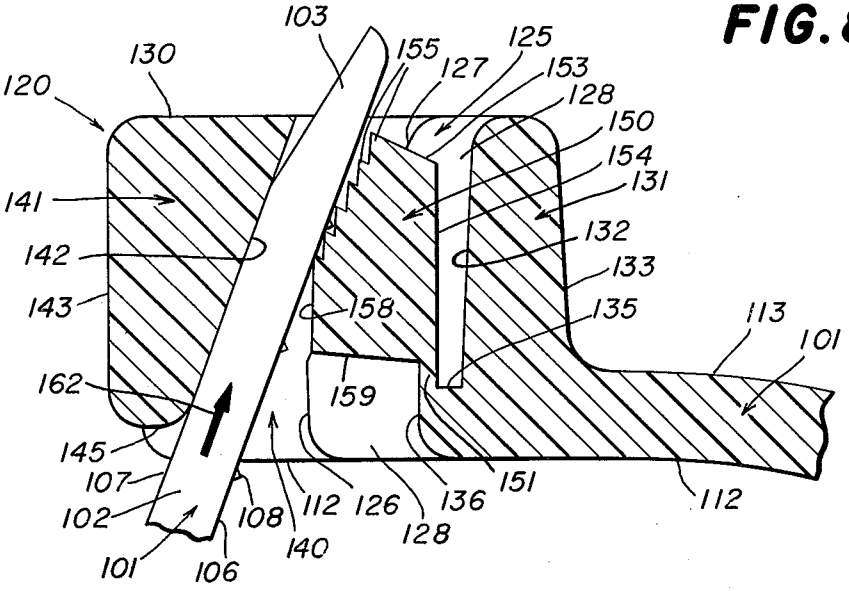

FIGS. 7 to 10, inclusive, are diagrammatical views illustrating the application of a cable tie about a bundle of wires.

Referring to FIGS. 1 to 3 of the drawings, there is shown an integral one-piece cable tie 100 made in accordance with and embodying the principles of the present invention. The cable tie 100 includes generally a strap 101 carrying on one end thereof a frame or head 120 having a strap-receiving opening or throat 140 therethrough in which is disposed a pawl 150. The cable tie 100 is typically used to bind a bundle 160 formed of a plurality of wires 161, and accordingly, the cable tie 100 has been illustrated in this end use in FIG. 4; however, it will be appreciated that the cable tie 100 can be advantageously used to bind other objects in a like manner.

A preferred material of construction of the cable tie 100 is a suitable synthetic organic plastic resin, the preferred resin being one of the polyamide resins; the resin must be sufficiently flexible to accommodate the deformation of the several parts of the cable tie 100 as illustrated throughout the drawings. It is an important object of the invention that each of the parts of the cable tie 100 is integral with the adjacent parts thereof, whereby the cable tie 100 is truly one-piece and formed integral throughout.

The strap 100 is elongated and flexible and includes an outer end 102 that is deflected downwardly as viewed in FIG. 2 with respect to the remaining portion of the strap 101 as molded, the outer end 102 carrying thereon a tip 103 provided with tapered sides 104. The outer end 102 further has an inner or bundle-engaging surface 106 and an outer surface 107, the inner surface 106 carrying a plurality of transversely spaced-apart pairs of gripping projections 108 equidistantly spaced along the length of the outer end 102. A high ridge or detent 109 is provided on the outer surface 107 and is arranged transversely with respect thereto and adjacent to the juncture 111 between the outer end 102 and the remaining portion of the strap 101. In use, the detent 109 is caused to engage the strap 101 on the frame 120 temporarily in an encircling position with respect to an associated bundle 160, all as will be explained more fully hereinafter.

The strap 101 further includes a pair of longitudinally extending strap sides 110 which extend the length of the strap 101, and there is provided on the portion of the strap 101 disposed between the juncture 111 with the outer end 102 and the juncture with the frame 120 an inner or bundle-engaging surface 112 and an outer surface 113. Disposed in the surface 112 is a row of abutments or teeth 115, the teeth 115 being disposed in a recessed position with respect to the surface 112 and extending laterally of the strap 101 and having a length slightly less than the width of the surface 112, whereby to be confined completely within the body of the strap 101. As illustrated, each of the teeth 115 has a shorter side 116 disposed substantially normal to the adjacent strap surface 112 and a longer or inclined side 117, see particularly FIG. 9.

The frame 120 is integral with the strap 101 and comprises a pair of side walls or members 121, a rear wall or member 131 and a front wall or member 141. As may best be seen in FIG. 6, the side walls 121 are laterally spaced apart and include inner surfaces 122 that extend the fully height of the frame 120 and are disposed essentially parallel to one another, the inner surfaces 122 more specifically extending from the inner surface 112 which serves as an entry surface for the frame 120 to an exit surface 130 on the top of the frame 120 as viewed in FIG. 6. The inner surfaces 122 further are spaced apart a distance greater than the distance between the strap sides 110, whereby the strap 101 may be received between the inner surfaces 122, all as will be explained more fully hereinafter. Each of the side walls 121 further includes an outer surface 123 that extends from the entry surface 112 to the exit surface 130.

There are provided on the inner surfaces 122 of the side walls 121 and integral therewith rails 125, the rails 125 extending inwardly toward one another. Each rail 125 includes a lower surface 126 disposed substantially normal to the entry surface 112 and an inclined surface 127 extending upwardly from the surface 126 to the exit surface 130, the surfaces 127 being inclined at an angle of about 65° with respect to the entry surface 112 and the longitudinal axis of the strap 101 as molded. The rails 125 further have inner surfaces 128 disposed toward each other and parallel to each other and spaced from the sides of the pawl 150.

Figure 7:
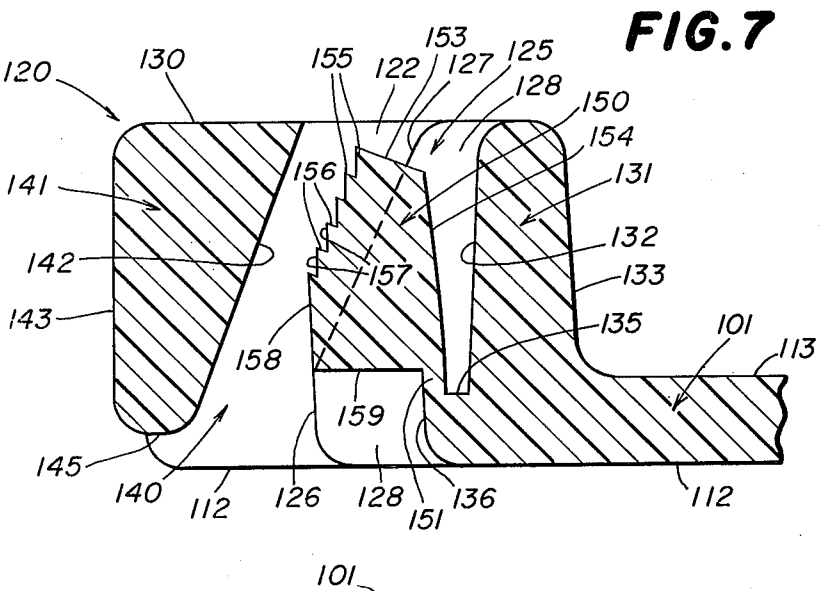

The rear wall or end wall 131 includes an inner surface 132 and an outer surface 133, the inner surface 132 diverging downwardly away from the outer surface 133 from the exit surface 130 to the entry surface 112, whereby the rear wall 131 is thicker at the bottom thereof as illustrated in FIG. 7 than at the top thereof. As is also illustrated in FIG. 7, the strap 101 is joined to the frame 120 at the lower and thicker portion of the end wall 131.

Extending between the side walls 121 and adjacent to the lower portion of the end wall 131 is a ledge 135 extending longitudinally toward the front wall 141 and disposed substantially parallel to the entry surface 112 and the longitudinal axis of the strap 101 as molded. The lefthand edge of the ledge 135 as viewed in FIG. 7 terminates in a vertical wall 136 that is disposed essentially normal to the entry surface 112 and is joined thereto by a curved portion thereof. More specifically, the ledge 135 and the surface 136 both extend from and in effect interconnect the inner surfaces 128 of the rails 125 on the side walls 121.

Figure 10:
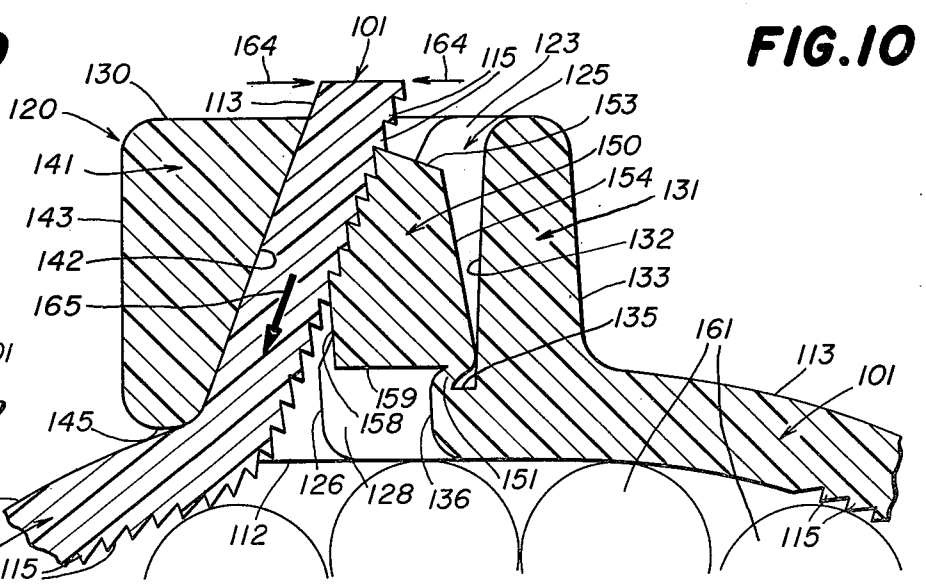

The front wall or abutment wall 141 has an inner surface 142 which is spaced from the rear wall 131 in the direction opposite to the strap 101, the inner surface 142 being inclined upwardly toward the exit surface 130 and in the direction of the strap 101 and being inclined at an angle of about 70° with respect to the longitudinal axis of the strap 101 as molded, the rear wall 131 and the abutment wall 141 cooperating to provide therebetween a strap-receiving opening 140 which has the longitudinal axis thereof inclined and generally parallel to the strap-bearing surface 142. It further will be noted that the inclined surface 127 of the rails 125 are also inclined in the same direction as the strap-bearing surface 142, but at a different angle. The front wall 141 also has an inner surface 143 which extends downwardly from the exit surface 130 and terminates a short distance away from the entry surface 112, and joins thereat a guide surface 145 which connects the inner surface 142 and the outer surface 143. More specifically, the guide surface 145 is spaced away from the entry surface 112 and together with the inner surfaces 122 of the side walls 121 defines a strap-receiving channel in the frame 120. The channel thus provides in the frame 120 and beneath the front wall 141 permits the frame 120 to lie more closely against the associated bundle 160 when the parts are in the tensioned condition as illustrated in FIGS. 4 and 10.

Mounted within the strap-receiving opening 140 in the frame 120 is the pawl 150, a flexible and collapsible hinge 151 of limited cross section serving integrally to interconnect the lower end of the pawl 150 to the forward or outer portion of the ledge 135. The pawl 150 has a pair of side surfaces 152 disposed essentially parallel to one another (see FIGS. 5 and 6), the side surfaces 152 being spaced apart a distance slightly less than the transverse dimensions of the teeth 115 on the strap 101. The pawl 150 also has a top surface 153 (see FIG. 7) and a rear surface 154 disposed toward the inner surface 132. A set of teeth 155 is provided on the surface of the pawl 150 disposed toward the inner surface 142, the teeth 155 each having a shorter side 156 and a longer inclined side 157. The shorter sides 156 are disposed substantially normal to the inner surface 142 when in the as-molded condition as illustrated in FIG. 7. The crests of the teeth 155 all lie in a common plane that is essentially parallel to the opposed inner surface 142 on the front wall 141 as molded; and the roots of the teeth 155 of the pawl 150 also lie in a common plane that is essentially parallel to the opposed inner surface 142 on the front wall 141 as molded. Furthermore, the crest-to-crest distance on the pawl teeth 155 is slightly less than the crest-to-crest distance on the strap teeth 115, whereby to insure that all of the teeth 155 on the pawl 150 engage the teeth 115 on the strap 101, as will be explained more fully hereinafter.

The pawl 150 further has a front surface 158 that is disposed toward the strap-bearng surface 142 but spaced therefrom and disposed normal to the entry surface 112. A bottom surface 159 is provided on the pawl 150 and is disposed substantially normal to the front surface 158 and extends therefrom to the hinge 151. As illustrated, the hinge 151 is essentially rectangular in lateral cross section and directly mounts the lower adjacent end of the pawl 150 on the forward edge of the ledge 135.

In use, the cable tie 100 is encircled about a bundle 160 of wires 161 as illustrated in FIG. 4. The frame 120 and the several parts associated therewith including the pawl 150 as shown in FIG. 7 in the as-molded condition and prior to the insertion thereinto of the strap 101. It will be noted that the crests of the teeth 155 lie in a plane that is essentially parallel to the inner surface 142 of the front wall 141. The first step in applying the cable tie 100 about the bundle 160 is to insert the outer end 102 into the frame 120 in the direction of the arrow 162 as illustrated in FIG. 8. The rows of gripping projections 108 are spaced apart a distance greater than the width of the teeth 155 so that the projections 108 will not engage the teeth 155 during the insertion of the outer end 102 into the frame 120. Furthermore, the rails 125 direct the strap end 102 along a path adjacent to the strap-bearing surface 142 so that there is minimal contact with the pawl 150. If desired, the detent 109 may be caused to engage the juncture between the exit surface 130 and the strap-bearing surface 142 temporarily to hold the strap 101 about a group of wires 161. In this manner, the workman can continue to add wires 161 to the bundle 160 or remove wires 161 therefrom, if required, all before engagement of the strap teeth 115 with the pawl teeth 155.

Figure 9:
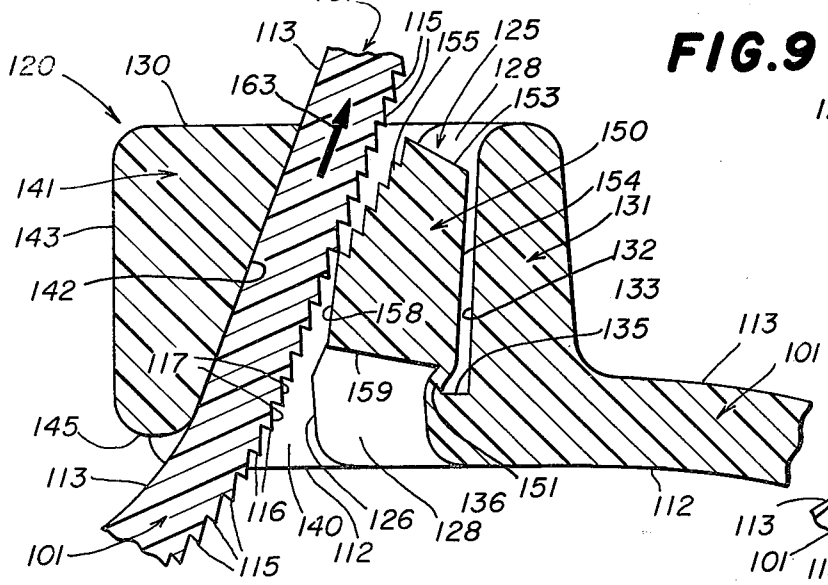

Thereafter, the user grasps the strap end 102 utilizing the projections 108 and pulls the strap further through the frame 120 in the direction of the arrow 163 in FIG. 9. The rails 125 continue to direct the strap 101 along a path adjacent to the strap-bearing surface 142 during this portion of the binding operation. Initial engagement between the strap 101 and the pawl 150 is with the lowermost one of the teeth 155, i.e., the tooth 155 disposed toward the entry surface 112, such engagement shifting and pivoting the pawl 150 from the position illustrated in FIG. 8 to that illustrated in FIG. 9, such movement of the pawl 150 being facilitated by the flexible and collapsible hinge 151. During further tightening movement of the strap 101 as illustrated in FIG. 9, the teeth 115 of the strap 101 successively engage the lowermost one of the teeth 155 on the pawl 150, thereby to hold the pawl 150 generally in the position illustrated during tightening movement of the strap 101 through the frame 120. Preferably a tool such as that illustrated in the Caveney and Moody U.S. Pat. No. 3,169,560, granted Feb. 16, 1965, or that illustrated in the Caveney & Moody Patent No. 3,254,680, granted May 7, 1966, is utilized to tighten the strap 101 about the bundle 160, which tool automatically at the end of the tightening operation severs the strap 101 at a point disposed beyond the exit surface 130 of the frame 120, such as is illustrated by the arrows 164 in FIG. 10.

Immediately after severing of the strap 101, the tension in the portion of the strap 101 about the bundle 160 tends to withdraw the strap 101 from the frame 120 in the direction of the arrow 165, i.e., in a retrograde or strap-withdrawal or strap-loosening direction. During such movement of the strap 101 relative to the frame 120, the tooth 115 disposed above the lowermost tooth 155 engages the lowermost tooth 155 and begins to pivot the pawl 150 in a counterclockwise direction from the position illustrated in FIG. 9 to that illustrated in FIG. 10, and bodily to shift the pawl 150 toward the entry surface 112. As the retrograde movement of the strap 101 continues, the teeth 155 above the lowermost tooth 155 progressively engage the teeth 115 of the strap 101 until all of the teeth 155 on the pawl 150 engage the adjacent ones of the teeth 115 on the strap 101. The parts finally arrive in the position illustrated in FIG. 10, the positions of the parts in FIG. 10 being the tensioned positions thereof including the tensioned position of the pawl 150.

The above described movement of the pawl 155 is facilitated by the flexible and collapsible hinge 151, whereby the pawl 150 is readily shifted out of the path of the strap 101 during insertion of the strap 101 into the frame 120, such shifting movement of the pawl 150 requiring a minimum of force, thereby to minimize the possibility of danger of injury to the teeth 155 on the pawl 150. Likewise, this ready shifting movement of the pawl 150 provides for easy manual insertion of the strap end 102 into the frame 120 and past the pawl 150. During the final tensioning movement of the parts from the position illustrated in FIG. 9 to that illustrated in FIG. 10, the ready collapsibility of the hinge 151 permits the pawl 150 to be readily seated upon the ledge 135, and once the pawl 150 is seated upon the ledge 135, there is a maximum resistance to further retrograde movement of the pawl 150 and the strap 101 since the pawl 150 is firmly supported in the tensioned position thereof by the ledge 135.

It will be noted that the hinge 151 has fully collapsed and the pawl 150 is seated upon the ledge 135 to be supported thereby, this position of the pawl 150 being rendered possible by the flexible and collapsible character of the hinge 151. With the parts in the position illustrated in FIG. 10, the strap 101 is firmly gripped between the abutment wall 141 and the pawl 150, and more specifically, the strap-bearing surface 142 on the abutment wall 141 is in firm engagement with the surface 113 on the strap 101 while certain of the teeth 115 on the strap 101 are in firm locking engagement with the teeth 155 on the pawl 150.

It is pointed out that the pawl 150 in the as-molded position thereof illustrated in FIG. 7 and at all of the other positions thereof including the flexed positions of FIGS. 8 and 9 and the tensioned position of FIG. 10 is disposed entirely within the frame 120 between the entry surface 112 and the exit surface 130 thereof. In other words, no part of the pawl 150 leaves the frame 120 during the application of the cable tie 100 about a bundle 160. The channel in the front wall 141 provided by the surface 145 thereof and the inner surfaces 122 on the side walls 121 assists in the entry of the strap 101 into the throat 140 and also assists in permitting the frame 120 to lie more nearly flat against the associated bundle 160.

Once the parts are in the tensioned condition of FIG. 10, any force tending to withdraw the strap 101 from within the throat 140 in a strap-loosening or strap-withdrawal direction serves to move the teeth 155 on the pawl 150 into a more firm engagement with the engaged ones of the teeth 115 on the strap 101, thereby firmly to grip the strap 101 between the strap-bearing surface 142 and the pawl 150. This described action prevents inadvertent withdrawal of the strap 101 from the frame 120, thus to lock the strap 101 in its tensioned condition about the bundle 160.

Referring again to FIG. 7 of the drawings, it will be appreciated that the crests of the teeth 155 lie on a common surface, i.e., a plane, which common surface is disposed substantially equidistant from the strap-bearing surface 142 along the length thereof in the as-molded condition of the parts. It further is pointed out that the strap-bearing surface 142 extends beyond the teeth 155 both toward the entry surface 112 and toward the exit surface 130, thereby to provide a backing for the engaged portion of the strap 101 in the tensioned condition of the parts, so that the engaged teeth 115 are encompassed by the strap-bearing surface 142. Furthermore, all of the teeth 155 in the tensioned condition are fully engaged and loaded.

The planes defined by the surfaces of the teeth 155 disposed toward the entry surface 112, i.e., the surfaces 157 in FIGS. 7 and 10, converge with the planes defined by the surfaces of the pawl 150 disposed toward the exit surface 130, i.e., the planes defined by the surfaces 153 and 154. The two sets of planes named converge at points disposed on the exit side of the frame, the convergence between the sets of planes being at angles as small as 0°, i.e., the sets of the planes might be essentially parallel. The configuration of these several surfaces permits the pawl 150 and the teeth 155 thereon to be properly molded as one-piece with the remaining portions of the cable tie 100.

Referring to FIG. 9, it will be noted that even in the most clockwise position of the pawl 150 with respect to the frame 120, there is ample clearance between the rear surface 154 of the pawl 150 and the inner surface 132 of the end wall 131, thereby to permit unrestricted flexure of the pawl 150 during insertion of the strap 101 into the frame 120. This feature is important to prevent damage to the teeth 155 on the pawl during insertion of the strap 101 through the frame 120.

Referring again to FIG. 10, it will be seen that a portion of the pawl 150 adjacent to the hinge 151 and at the lower end of the rear surface 154 contacts the surface 132 after the pawl 150 is pivoted and shifted downwardly and rearwardly, this portion of the pawl 150 serving as a stop member to limit the rearward shifting of the pawl 150.

In a constructional example of the cable tie 100 for use with bundles having a diameter of 1.75 inches, the overall length thereof is 7.5 inches, the width of the strap 101 is 0.180 inch, the length of the outer end 102 is 1.225 inches, the portion of the strap carrying the teeth 115 has a length of 5.67 inches, the depth of the teeth 115 is 0.010 inch, and the pitch thereof is 0.025 inch, the inclination of the surfaces 117 to the surface 112 being 22°; the dimension of the frame 120 in the direction of the strap 101 is 0.260 inch, the overall height of the frame 120 is 0.195 inch, the overall width of the frame 120 is 0.320 inch, and the inclination of the several surfaces 123, 132, 133, 143 and 154 is 3°; the surface 142 is inclined at an angle of 70° with respect to the entry surface 112 and with respect to the longitudinal axis of the strap 101 as molded; the thickness of the strap 101 is 0.040 inch, while the thickness of the hinge 151 is 0.010 inch and the height thereof is 0.015 inch and the width thereof is 0.100 inch; the inclined surfaces 127 of the rails 125 are disposed at an angle of 65° with respect to the entry surface 112 and the longitudinal axis of the strap 101 as molded; the surfaces 156 of the teeth 155 are disposed substantially normal to the surface 142.

From the above, it will be seen that there has been provided an improved cable tie fulfilling all of the objects and advantages set forth above.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a rigid ledge on said end wall extending longitudinally therefrom toward said abutment wall, a pawl disposed within said frame in said strap-receiving opening, flexible hinge means extending from said ledge toward said exit surface and pivotally interconnecting said ledge and said pawl, said hinge means normally spacing said pawl from said end wall and being collapsible toward said ledge to lock the strap in a tensioned condition about a bundle of wires, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and thereby beyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to collapse said hinge means to enable a portion of said pawl to abut said end wall and to enable said pawl to pivot about said hinge to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

2. The integral one-piece cable tie set forth in claim 1, wherein said pawl in the as-molded position thereof and in all other positions thereof including the tensioned position thereof is disposed entirely within said frame between the entry and exit surfaces thereof.

3. The integral one-piece cable tie set forth in claim 1, wherein said frame has a channel therein through said abutment wall for receiving the other end of said strap, thus to permit said frame to lie more nearly flat upon the associated bundle of wires.

4. The integral one-piece cable tie set forth in claim 1, wherein said end wall is relatively thicker adjacent to said entry surface and is relatively thinner adjacent to said exit surface in a direction disposed longitudinal of said strap, said ledge being disposed on said end wall at the thicker portion thereof.

5. The integral one-piece cable tie set forth in claim 1, and further comprising a pair of rails integral with said frame and respectively disposed on opposite sides of said pawl and extending into said strap-receiving opening in position to guide the free end of said strap along a path adjacent to said strap-bearing surface.

6. The integral one-piece cable tie set forth in claim 1, wherein the axis of said strap-receiving throat is disposed at an acute angle of less than 90° with respect to the longitudinal axis of said strap as molded.

7. An integral one-piece cable tie to be tensioned about a bundle of wires and the like, said cable tie comprising an elongated flexible strap, a row of teeth disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame between said ledge and said exit surface in said strap-receiving opening and pivotally mounted on said ledge, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, said pawl in the tensioned condition being firmly seated upon said ledge thereby to prevent motion of said pawl toward said entry surface, whereby to prevent inadvertent withdrawal of said strap from said frame and thus to lock said strap in its tensioned condition about the bundle of wires.

8. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an abutment wall, said frame having an entry surface and an exit surface and a strap-receiving opening extending therethrough, a ledge on said end wall extending longitudinally therefrom toward said abutment wall, a pawl disposed within said frame in said strap-receiving opening, a flexible and collapsible hinge interconnecting said ledge and the end of said pawl disposed toward said entry surface, said abutment wall having a strap-bearing surface disposed toward said pawl and defining therewith a strap-receiving throat, and a tooth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, initial retrograde movement of said strap exerting pressure on said pawl causing said hinge to collapse and to seat said pawl upon said ledge in a tensioned position firmly gripping said strap between said strap-bearing surface and said pawl, any force tending to withdraw said strap from within said strap-receiving throat and a strap-loosening direction serving to move said tooth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

9. The integral one-piece cable tie set forth in claim 8, wherein said pawl in the as-molded position thereof and in all other positions thereof including the tensioned position thereof is disposed entirely within said frame between the entry and exit surfaces thereof.

10. The integral one-piece cable tie set forth in claim 8, wherein said hinge has a width substantially equal to the width of said pawl.

11. The integral one-piece cable tie set forth in claim 8, wherein said frame has a channel therein on the entry side thereof through said abutment wall for receiving the other end of said strap, thereby to permit said frame to lie closer to the associated bundle of wires.

12. The integral one-piece cable tie set forth in claim 8, wherein said end wall is relatively thicker adjacent to said entry surface and is relatively thinner adjacent to said exit surface in a direction disposed longitudinally of said strap, said ledge being disposed toward said entry surface of said frame at the thicker portion of said end wall.

13. The integral one-piece cable tie set forth in claim 8, and further comprising a pair of rails integral with said frame and respectively disposed on opposite sides of said pawl and extending into said strap-receiving opening in positions to quide the free end of said strap along a path adjacent to said strap-bearing surface.

14. The integral one-piece cable tie set forth in claim 8, wherein the axis of said strap-receiving throat is disposed at an acute angle of less than 90° with respect to the longitudinal axis of said strap as molded.

15. An integral one-piece cable tie to be tensioned about a bundle of wires and the like, said cable tie comprising an enlongated flexible strap, a row of teeth disposed on one longitudinal surface of said strap and arranged transversely with respect thereto, a frame integral with one end of said strap and including a pair of longitudinally extending and spaced-apart side walls and an end wall joining first corresponding ends of said side walls and an abutment wall joining the other corresponding ends of said side walls, said frame having an entry surface and an exit surface and a strap-receiving opening extending therethrough, a ledge on said frame within said strap-receiving opening extending along said side walls and said end wall and longitudinally toward said abutment wall, a pawl disposed within said frame in said strap-receiving opening, a flexible and collapsible hinge interconnecting said ledge and the end of said pawl disposed toward said entry surface, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, the initial retrograde movement of said strap exerting pressure on said pawl causing said hinge to collapse and to seat said pawl upon said ledge in a tensioned position firmly gripping said strap between said strap-bearing surface and said pawl, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

16. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a rigid ledge on said end wall extending longitudinally therefrom toward said abutment wall, a pawl disposed within said frame in said strap-receiving opening and pivotally mounted on and integral with said ledge, the longitudinal extent of said pawl at its juncture with said ledge being less than the longitudinal extent of said ledge, said abutment wall having a strap-bearing surface disposed toward said pawl and defining therewith a strap-receiving throat, and a set of teeth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said set of teeth being disposed toward said row of abutments as said strap is tensioned about the bundle of wires to a tensioned condition and release of said strap causing at least certain ones of said row of abutments firmly to engage said set of teeth, any force tending to withdraw said strap from within said strap-receiving throat in a strap-loosening direction serving to move said set of teeth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

17. The integral one-piece cable tie set forth in claim 16, wherein the crests of a plurality of teeth in said set of teeth are positioned opposite said strap-bearing surface and lie in a common surface that is disposed substantially equidistant from said strap-bearing surface in the tensioned condition of said strap with said strap-bearing surface extending beyond said plurality of teeth.

18. The integral one-piece cable tie set forth in claim 16, wherein the crests of a plurality of the teeth in said set of teeth are positioned opposite said strap-bearing surface and lie in a plane substantially parallel thereto in the tensioned condition of said strap with said strap-bearing surface extending beyond said plurality of teeth.

19. The integral one-piece cable tie set forth in claim 16, wherein the planes defined by the surfaces of said set of teeth disposed toward said entry surface in the tensioned condition converge with the planes defined by the surfaces of said pawl disposed toward said exit surface and away from said abutment wall in the tensioned condition at points disposed on the exit side of said frame at angles as small as 0°.

20. An integral one-piece cable tie to be tensioned about a bundle of wires and the like, said cable tie comprising an elongated flexible strap, a row of teeth disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening and pivotally mounted on and integral with said ledge, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, the crest-to-crest distance of said set of teeth being slightly less than the crest-to-crest distance of said row of teeth so that when the tooth in said set of teeth disposed toward said entry surface is the first to engage one of said row of teeth all of the teeth in said set of teeth will ultimately engage teeth in said row of teeth, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

21. The integral one-piece cable tie set forth in claim 20, wherein said frame further includes a pair of longitudinally extending and spaced-apart side walls with the end wall joining one end of the side walls and the abutment wall joining the other end of the side walls, said ledge extending along said side walls and said end walls and longitudinally toward said abutment wall.

22. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening, a flexible and collapsible hinge interconnecting said ledge and the end of said pawl disposed toward said entry surface, said abutment wall having a strap-bearing surface disposed toward said pawl and defining therewith a strap-receiving throat, and a set of teeth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said set of teeth being disposed toward said row of abutments as said strap is tensioned about the bundle of wires to a tensioned condition and release of said strap causing at least certain ones of said row of abutments firmly to engage said set of teeth, the crests of a plurality of teeth in said set of teeth being positioned opposite said strap-bearing surface and lying in a common surface that is disposed substantially equidistant from said strap-bearing surface in the tensioned condition of said strap with said strap-bearing surface extending beyond said plurality of teeth, initial retrograde movement of said strap exerting pressure on said pawl causing said hinge to collapse and to seat said pawl upon said ledge in a tensioned position firmly gripping said strap between said strap-bearing surface and said pawl, any force tending to withdraw and strap from within any strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

23. The integral one-piece cable tie set forth in claim 22, wherein the crests of a plurality of teeth in said set of teeth are positioned opposite said strap-bearing surface and lie in a plane substantially parallel thereto in the tensioned condition of said strap with said strap-bearing surface extending beyond said plurality of teeth.

24. The integral one-piece cable tie set forth in claim 22, wherein the planes defined by the surfaces of said set of teeth disposed toward said entry surface in the tensioned condition converge with the planes defined by the surfaces of said pawl disposed toward said exit surface and away from said abutment wall in the tensioned condition at points disposed on the exit side of said frame at angles as small as zero degree.

25. The integral one-piece cable tie set forth in claim 22, wherein the crest-to-crest distance of said set of teeth is slightly less than the crest-to-crest distance of said row of teeth so that when the tooth in said set of teeth disposed toward said entry surface is the first to engage one of said row of teeth all the teeth in said set of teeth will ultimately engage teeth in said row of teeth.

26. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including a rear wall and an abutment wall, said frame having an entry surface and an exit surface and a strap-receiving opening extending therethrough, a pawl disposed within said frame in said strap-receiving opening and having a rear wall disposed toward said frame rear wall, a hinge interconnecting said frame and the end of said pawl disposed toward said entry surface, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, said pawl in the strap-locking position thereof having the portion of said pawl rear wall adjacent to said hinge in abutment with the adjacent portion of said frame rear wall positively to limit further movement of said pawl, whereby to prevent inadvertent withdrawal of said strap from said frame and thus to lock said strap in its tensioned condition about the bundle of wires.

27. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a rigid ledge on said end wall extending longitudinally therefrom toward said abutment wall, a pawl disposed within said frame in said strap-receiving opening and pivotally mounted on and integral with said ledge, the longitudinal extent of said pawl at its juncture with said ledge being less than the longitudinal extent of said ledge, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

28. A cable tie to be tensioned about a bundle of wires and the like, said cable tie comprising an elongated flexible strap, a row of teeth disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening and pivotally mounted on and integral with said ledge, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, the crest-to-crest distance of said set of teeth being slightly less than the crest-to-crest distance of said row of teeth so that when the tooth in said set of teeth disposed toward said entry surface is the first to engage one of said row of teeth all the teeth in said set of teeth will ultimately engage teeth in said row of teeth, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

29. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening, a flexible and collapsible hinge interconnecting said ledge and the end of said pawl disposed toward said entry surface, said abutment wall having a strap-bearing surface disposed toward said pawl and defining therewith a strap-receiving throat, and a tooth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, initial retrograde movement of said strap exerting pressure on said pawl causing said hinge to collapse and to seat said pawl upon said ledge in a tensioned position firmly gripping said strap between said strap-bearing surface and said pawl, any force tending to withdraw said strap from within said strap-receiving throat in a strap-loosening direction serving to move said tooth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

30. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a rigid ledge on said end wall extending longitudinally therefrom toward said abutment wall including a support surface disposed toward said entry surface, a pawl disposed within said frame in said strap-receiving opening and pivotally mounted on an integral with the support surface of said ledge, the longitudinal extent of said pawl at its juncture with said support surface being less than the longitudinal extent of said support surface, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

* * * * *

Disclaimer 3,949,449.—*Jack E. Caveney,* Chicago, and *Roy A. Moody,* Flossmoor, Ill. INTEGRAL ONE-PIECE CABLE TIE. Patent dated Apr. 13, 1976. Disclaimer filed Oct. 10, 1984, by the assignee, *Panduit Corp.*

The term of this patent subsequent to May 9, 1989 has been disclaimed.

[*Official Gazette December 11, 1984.*]